US007798879B2

(12) United States Patent
James et al.

(10) Patent No.: US 7,798,879 B2
(45) Date of Patent: Sep. 21, 2010

(54) PERSONAL FLOTATION DEVICE

(76) Inventors: Crosby James, P.O. Box 720069, Pinon Hills, CA (US) 92372; Allen Arthur Jones, P.O. Box 189010-PMB 193, Coronado, CA (US) 92178; James Arthur Crosby, 1033 "B" Ave., Ste 101, PMB 125, Coronado, CA (US) 92118

( * ) Notice: Subject to any disclaimer, the term of this patent is extended or adjusted under 35 U.S.C. 154(b) by 0 days.

(21) Appl. No.: 12/321,429

(22) Filed: Jan. 21, 2009

(65) Prior Publication Data

US 2010/0184344 A1 Jul. 22, 2010

(51) Int. Cl.
*B63C 9/08* (2006.01)

(52) U.S. Cl. ..... 441/118; 441/132

(58) Field of Classification Search ..... 441/88, 441/106, 112, 117, 118, 132; 405/185, 186
See application file for complete search history.

(56) References Cited

U.S. PATENT DOCUMENTS

| | | | | | |
|---|---|---|---|---|---|
| 2,550,562 | A * | 4/1951 | Hurt et al. | ..... | 441/116 |
| 3,152,344 | A | 10/1964 | Radnofsky et al. | | |
| 3,193,856 | A * | 7/1965 | Coolidge | ..... | 441/123 |
| 3,681,799 | A | 8/1972 | Smith | | |
| 3,742,538 | A | 7/1973 | Smith | | |
| 3,771,183 | A | 11/1973 | Moran | | |
| 3,925,838 | A | 12/1975 | Kennedy | | |
| 3,988,795 | A | 11/1976 | Robertson | | |
| 4,555,234 | A * | 11/1985 | Kent | ..... | 441/106 |
| 4,654,016 | A * | 3/1987 | Pendleton | ..... | 441/116 |
| 5,494,469 | A * | 2/1996 | Heath et al. | ..... | 441/118 |
| 5,928,046 | A * | 7/1999 | Constan-Tatos | ..... | 441/118 |
| 6,007,395 | A * | 12/1999 | Kroll | ..... | 441/106 |
| 6,168,488 | B1 | 1/2001 | Yu-Tsai | | |
| 6,620,010 | B2 | 9/2003 | Noonan | | |
| 6,692,322 | B1 * | 2/2004 | Heatherly | ..... | 441/132 |
| 6,749,475 | B2 * | 6/2004 | Howerton | ..... | 441/132 |
| 6,837,764 | B2 * | 1/2005 | Bradley | ..... | 441/106 |

* cited by examiner

*Primary Examiner*—Lars A Olson
(74) *Attorney, Agent, or Firm*—Lewis M Brande; Thomas A. McCleary; Brande & McCleary

(57) ABSTRACT

This invention describes a buoyancy aid that is pre-formed from a buoyant foam plastic material and has an pre-formed internal tube that is sealed. The internal tube and the pre-formed buoyant foam are all shaped to provide support for a users head, and is designed to keep the users head above water. The buoyancy aid has an external covering that is selected to prevent chafing the user, as well as being water and mold resistant. The buoyancy aid is so designed as to be comfortable to the user, and enhance the wearers use of the buoyancy aid.

1 Claim, 4 Drawing Sheets

20
22
12
10
16
12
8
4
5
5
4

PERSONAL FLOTATION DEVICE

BACKGROUND OF THE INVENTION

1. Field of the Invention

This invention consists of a personal flotation device that is lightweight, simple to manufacture and easily stored.

2. Description of the Prior Art

Flotation devices with one or more buoyant members to be worn around a person's neck are described in the following patents:

U.S. Pat. No. 3,152,344 (hereinafter '344 patent) by M. I. Radnovsky, et al. Feb. 15, 1963 discloses a Life Preserver. The '344 patent is an inflatable device that assumes the shape of a "rams horn" when fully inflated, eliminating the need for fastening devices. Another feature of the invention is that the users body is kept in a vertical position when in water.

U.S. Pat. No. 3,681,799 (hereinafter '799 Patent) by Eric P. Smith Aug. 8, 1972 discloses a "Life Preserver". Life Preserver. The '799 patent discloses an primarily inflatable device that allows the user to place his arms through curved wings, that horizontally encircle the body, but is still resilient enough to pass over the head of the user.

U.S. Pat. No 3,771,183 (hereinafter the '183 patent) by Harold J. Moran, Nov. 13, 1973 discloses a Life Preserver. This device uses separate compartmental lobes that are positioned on the users body, and must be inflated in order to provide the requisite buoyancy.

U.S. Pat. No. 3,742,538 (hereinafter '538 patent) by Eric P. Smith, Jul. 3, 1973 discloses a Reversible Life Preserver. This device comprises two circular supports that are attached, and allow the user to place each are through the each circular support, and be supported at the shoulder joint. This device, like others, must be inflated, and is provided with sealed compartments to assure the inflated device provides the proper buoyancy for the user.

U.S. Pat. No. 3,925,838 (hereinafter the '838 patent) by Patrick Hayes Kennedy, Dec. 16, 1975 discloses an Inflatable Life Preserver. The '838 patent is described as a toroidal shape with a closed tubular core that is inflatable. The ends are fastened together to fix the toroidal shape. Engaging the ends of the core, allows the pressurized gas inside to escape, and thereby inflate the tubes. The user may wear the device around the neck or waist.

U.S. Pat. No. 3,988,795 (hereinafter the '795 patent) by James H. Robertson, Nov. 2, 1976 discloses a Life Preserver. The '795 patent is described as having a rectangular shape. Molded into one end of the preserver is a strap that uses oppositely directed D-ring fastener members. One end of the strap extends around the user, and has a buckle that may be attached to either of the rings.

U.S. Pat. No. 6,168,488 B1 (hereinafter the '488 patent) by Chen Yu-Tsai, Jan. 2, 2001 discloses a Life Jacket. The '488 patent uses a flat board shaped floating member that has a head hole, and extends towards the waist on the front and back of the user. The device is provided with straps that are biased towards the bottom of the front and rear board shaped members. Additionally there is a hole in the rear portion to specifically reduce the buoyancy of the device, making the front more buoyant than the rear. At least one cloth layer is adhered to the front and rear surface of the device increasing the structural strength of the device.

U.S. Pat. No. 6,620,010 (hereinafter the '010 patent) by Mary C. Noonan, Sep. 16, 2003 discloses a Buoyancy Aid. The '010 patent is designed around the form of a harness. The harness is made from some buoyant material which are joined in the front essentially by a 'V' shape, and joined in the back essentially by a Y shape. The "U" and "V" shaped portions straddle the shoulders of a person. The harness is attached by some fastening member. The invention is disclosed as being equaly disposed on the front and back of a users torso. The '010 patent differs from the current invention in that the strap member attaches in the front, and is passed through a looped belt to secure the buoyance aid in position. Another substantial difference is that the '010 patent is designed to maintain the user in an upright position in the water, and does not provide any support for the users head, allowing the head to sway or lean, and possibly dip into the water, potentially drowning the user. The present invention is designed to maintain the user in a chest high position in the water, and provide support for the users head, preventing the user from aspirating water. The majority of the buoyant material of the present invention is located on the users chest and stomach, forcing the user to be buoyed with his face upwards.

SUMMARY OF THE INVENTION

Prior art inventions typically rely upon either great amounts of inflatable air or a closed cellular foam material that provides buoyancy flotation. The present invention seeks to overcome shortcomings of the prior art. The present invention seeks to provide a buoyance aid that will provide greater safety to the user by forcing the users chest and head towards the air. The present invention combines an encapsulated and sealed air chamber as well as using a cellular closed cell foam material in concert to provide improved volume to buoyancy ratios. The majority of buoyancy aids have a minimum of 0.50 cubic feet of volume in order to achieve the buoyancy requirements of the government, while the present invention provides improved buoyancy with only 0.10 cubic feet of volume.

It is an object of the present invention to provide support for the users head, maintaining the head above the water, and preventing the user from aspirating water, and potentially drowning.

It is another object of the invention to provide a buoyancy aid that is easy to manufacture, and is inexpensive.

It is another object of the invention to provide a buoyancy aid that provides support for a person to be safely lifted out of the water It is another object of the invention to provide a buoyancy aid that provides simpler fit and also provides a one-size-fits all.

A final object of the invention is to provide a buoyancy aid that has improved mass vs buoyancy ratio and is smaller and less obtrusive than the prior art.

DETAILED DESCRIPTION

Figure 1:
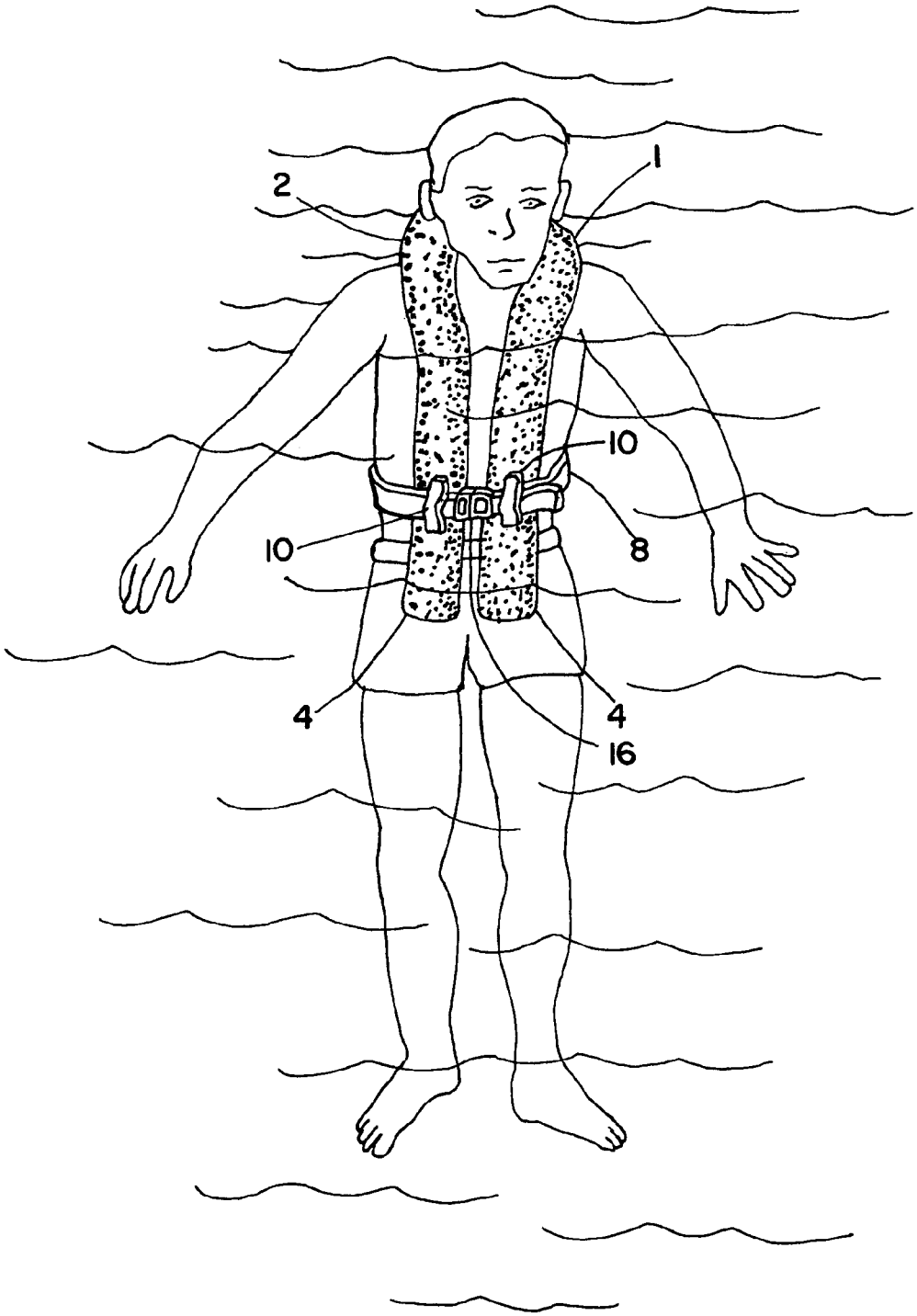
FIG. 1 shows the life preserver worn by a user
Figure 2:
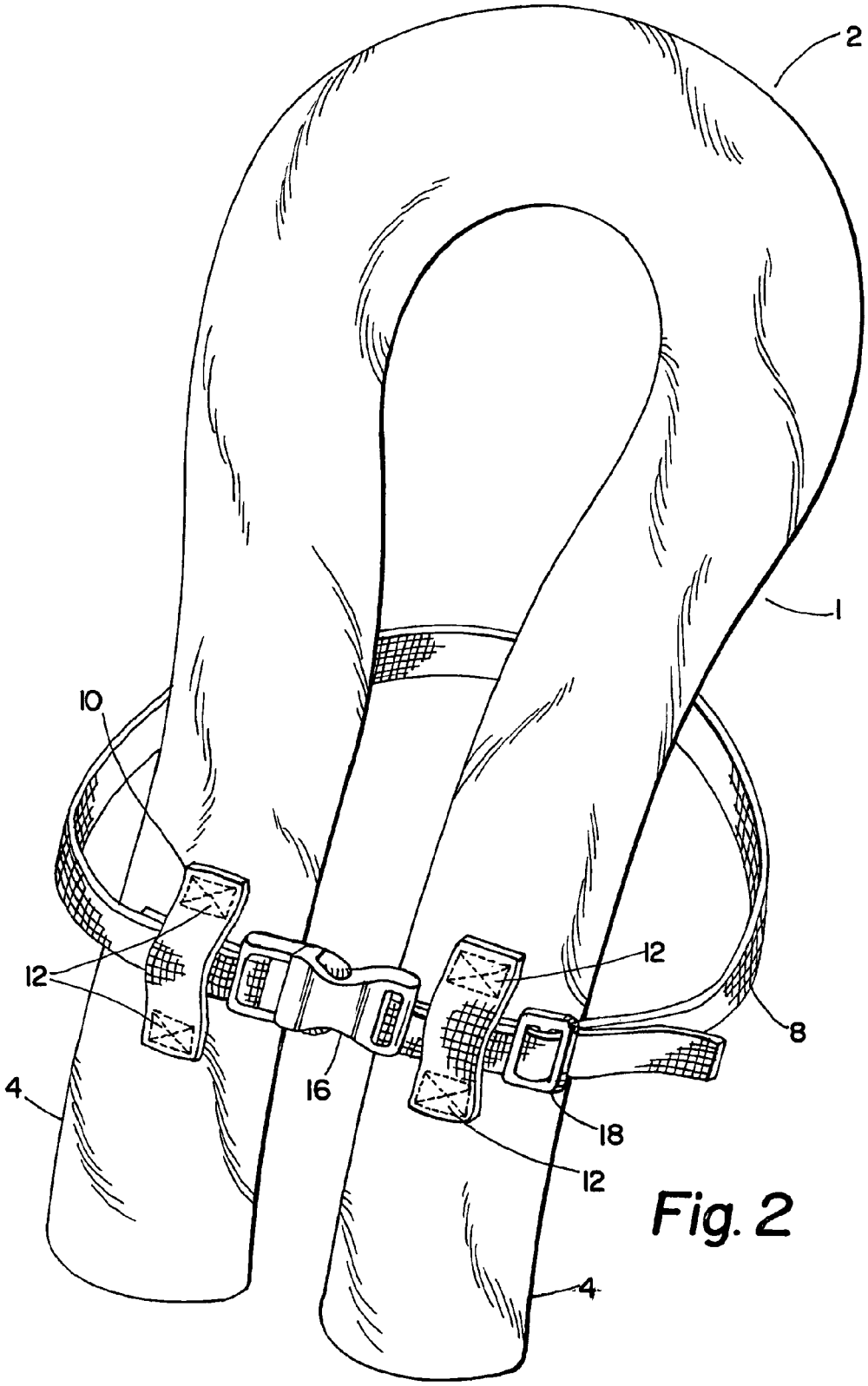
FIG. 2 shows an overall perspective view of the life preserver.
Figure 3:
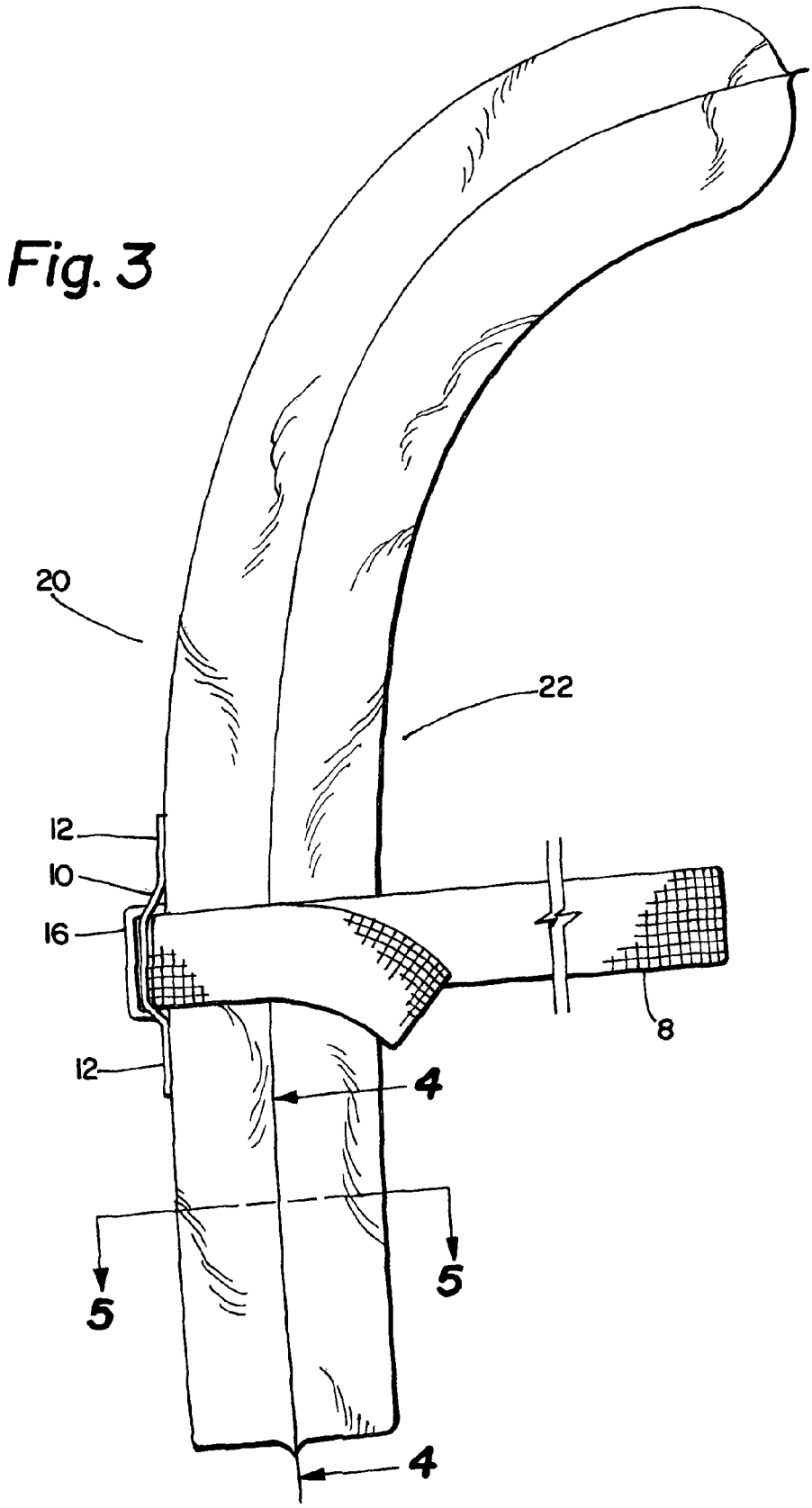
FIG. 3 shows an edge view of the life preserver.
Figure 4:
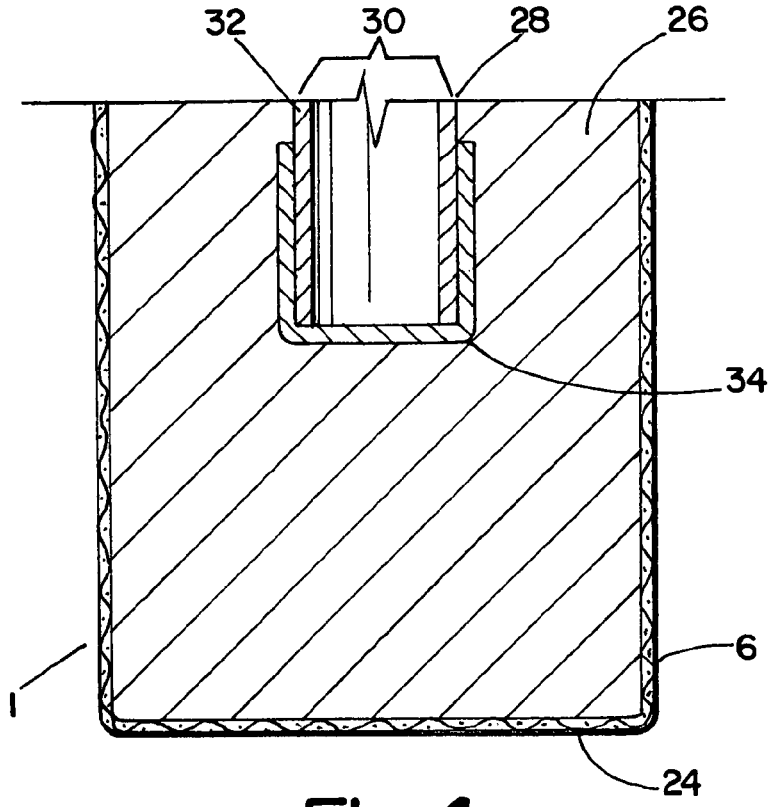
FIG. 4 shows a longitudinal cross sectional view of the life preserver.

With respect to figures one and two, we show a flotation device, or commonly known as a life preserver (1). The life preserver (1) is shown having a generally U-shaped design. The life preserver (1) is shown having a curved portion (2)

and legs (4). The curved portion (2) of the U is shown wrapping around the users neck, where the life preserver (1) wraps around the back of the users neck, and provides buoyant support for the users head. The legs (4) of the life preserver (1) are shown as being extended and terminating below the users waist.

The life preserver (1) is shown having an external covering (6). The protective sheath (6) is made from a material that prevents chafing on the users skin, yet is mold resistant and waterproof. The protective sheath (6) may be made from a nylon type material. The protective sheath (6) is shown enclosing the entire life preserver (1). Located midway along the legs (4) of the life preserver (1) is a strap (8). The strap (8) is retained on the legs (4) of the life preserver by retainer straps (10). The life preserver (1) is shown with at least two (2) retainer straps (10), where each retainer strap (10) is located on a leg (4) of the life preserver (1). Each retainer strap (10) is shown as a flat strip of material. The most secure method of retaining each retainer strap (10) on the leg (4) of the life preserver (1) is by sewing each end (12) onto the leg (4) of the life preserver (1) creating a pass through loop (14) therebetween. The strap (8) is retained on the body of the user by a retainer (16). The retainer (16) is generally located between the legs (4) and hence the retainer straps (10) of the life preserver (1). By locating the retainer (16) between the retainer straps (10), inadvertent dislocation of the retainer (16) away from the preferred location is prevented. The strap (8) has a industry common (standard) adjuster (18). It should be noted that the majority of the buoyancy aide is biased towards the users chest and waist, curving around and supporting the users head.

Figure 5:
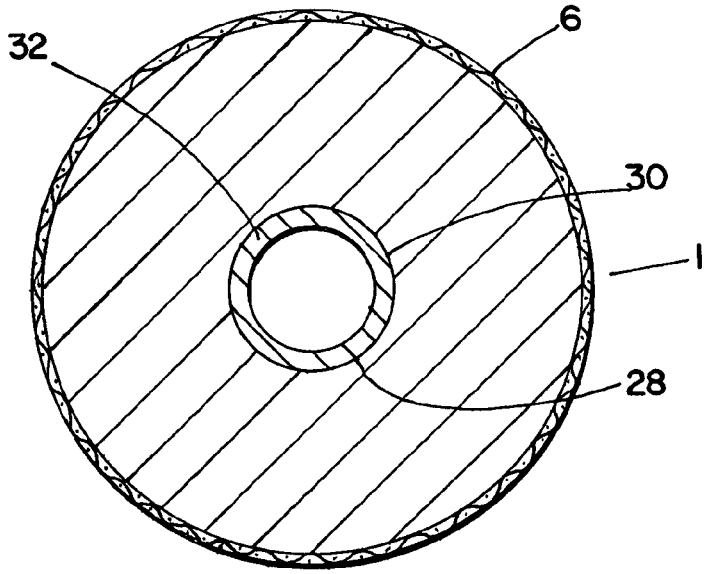
FIG. 5 shows a lateral cross sectional view of the life preserver.

With respect to figures three, four, and five, we show that the retainer straps (10) are biased towards the front (20) of the life preserver, and thereby, the strap (8) wraps around the rear (22) of the life preserver. Figure four shows a lateral cross section of the life preserver (1), which depicts the bottom (24) of each leg (4) of the life preserver (1). The internal structure of the life preserver (1) is shown as being constructed from a foam like material (26). The foam like material (26) must be buoyant, so it is foreseen that the material will be of a blown plastic or other material that has a positive buoyancy. As shown in FIG. 5 the general cross shape of the life preserver (1) is circular, but also may be oval or rectangular with rounded edges.

The life preserver (1) is shown having a centrally defined circular hole (28). The circular hole (28) goes through the majority of the life preserver (1) creating a circular cavity (30) but does not penetrate through the bottom (24) of each leg (4) of the life preserver (1). Positioned within the circular cavity (30) is a pre-formed tube (32). The preformed tube (32) is shown as being defined as hollow, and having a sealed terminating cap (34) on each end of the tube (32). The tube (32) must have a thickness that allows easy forming to the desired shape as well as having the ability to encapsulate air therein, providing additional buoyancy thereby. The air encapsulated within the (sealed) tube (32) may be ambient pressure, or may be higher pressure, or of a lighter-than-air gas which will provide the greatest buoyancy in water for the dollars spent on the product. It is foreseen that the preformed tube (32) would be heat formed in order to prevent future product distortions due to environmental conditions. The preformed tube (32) may be made from Poly-Vinyl-Chloride (PVC) tubing which is easily heat formed, and holds its shape well. The PVC tubing additionally is easily constructed so as to be easily sealed, preventing any leaks.

As depicted in figure three, the tube (32) provides rigidity to maintain the curvature, or shape of the life preserver (1). The legs (4) of the life preserver (1) generally are positioned on the chest of the user and extend towards the users waist. The legs (4) are also shown having a slight bend towards the rear (22) allowing the legs (4) to extend past the shoulders of the user with the rearward curve where the U-shaped portion (2) is shown wrapping around the users head and providing support for the head. The strap (8) is fastened around the users waist. The life preserver (1) provides positive buoyancy, which pulls the users body up, keeping the front of the user, and hence the face above the water. The U-shaped portion (2) of the life preserver (1), provides support for the users head, and keeps the users head and face pointed towards the sky.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A buoyancy aid or life preserver for maintaining the chest and head of a user facing upwards comprising:

a. a shaped member, said shaped member having a curved portion and legs, being essentially U-shaped and having a cross section, said U-shaped member having legs that are extended and terminate below the user's waist, said curved portion wrapping around a user's neck providing buoyant support for the head thereby;

b. said buoyancy aid has an external covering, said external covering being made from a material that prevents chafing on the user's skin, said external covering being mold resistant and water resistant, said external covering enclosing said buoyancy aid;

c. said buoyancy aid has a strap, said strap being positioned midway along said legs of said buoyancy aid, said strap being retained on said external covering encapsulating said legs of said buoyancy aid by retainer straps, said buoyancy aid having at least two retainer straps, mounted thereon, each retainer strap being located on one of said leg of said buoyancy aid, said retainer strap being constructed to be secured onto said external covering on each of said legs of said buoyancy aid by an attachment means creating a pass through loop therebetween, said strap being secured to the user by a retainer means, said retainer means being generally located between said legs and hence said retainer straps of said buoyancy aid, preventing inadvertent dislocation of said retainer from a preferred location, said strap additionally has an adjuster means thereattached;

d. said buoyancy aid has a centrally defined circular hole defined therein, said centrally defined circular hole penetrates through the buoyancy aid creating a circular cavity therein, said circular cavity does not penetrate through a bottom of each of said legs of said buoyancy aid; and e. a pre-formed tube is positioned within said circular cavity, said pre-formed tube has a hollow portion, said pre-formed tube additionally is sealed with a terminating cap, said terminating cap being located on each end of said tube, said tube has a thickness that allows easy forming to a desired shape as well and the ability to encapsulate air therein, providing additional buoyancy thereby, the pre-formed tube may be heat formed preventing future product distortions thereby.

* * * * *